United States Patent [19]

Carver et al.

[11] 4,125,223

[45] Nov. 14, 1978

[54] AIR FIELD SPACE HEATER FOR FOG DISPERSAL SYSTEM

[75] Inventors: George P. Carver, Newport Beach; Frank C. Price, Jr., Santa Ana; Thomas J. Tyson, Turtle Rock, all of Calif.

[73] Assignee: Ultrasystems, Inc., Irvine, Calif.

[21] Appl. No.: 788,558

[22] Filed: Apr. 18, 1977

[51] Int. Cl.[2] ..... E01H 13/00

[52] U.S. Cl. ..... 239/14

[58] Field of Search ..... 239/2 R, 14; 47/2; 98/DIG. 1; 244/114 R

[56] References Cited

U.S. PATENT DOCUMENTS

| | | | |
|---|---|---|---|
| 2,522,667 | 9/1950 | De Land | 239/14 X |
| 2,969,920 | 1/1961 | Giannoni | 239/14 |
| 3,118,604 | 1/1964 | Bertin et al. | 239/14 |
| 3,196,822 | 7/1965 | Bertin et al. | 244/114 R X |
| 3,227,373 | 1/1966 | Bertin et al. | 239/14 X |
| 3,603,507 | 9/1971 | Devlin | 239/14 |

FOREIGN PATENT DOCUMENTS

| | | | |
|---|---|---|---|
| 713,967 | 7/1965 | Canada | 239/14 |

*Primary Examiner*—Johnny D. Cherry

*Attorney, Agent, or Firm*—Fulwider, Patton, Rieber, Lee & Utecht

[57] ABSTRACT

An air field space heater for a fog dispersal system of the type having a plurality of heaters for generating heated air along an aircraft runway. The heater generates heated air and directs it in the form of air jets with properly controlled magnitude of momentum at various angles of inclination relative to the plane of the runway, the angle of inclination being adjustable for dispersing fog under a variety of wind conditions. One form of the heater includes two warm air projectors coupled to two combustors. A single source of thrust power operates two propellers, one for each combustor. The air from the propellers, warmed by the combustors, flows into a pair of elbow conduits which are pivotable to pivot the projectors about a generally horizontal axis for adjustment of the angle of inclination of the projected air jets. The elbow conduits include fixed, low-loss turning vanes, and provide an efficient system for projecting the two air jets at various angles and with minimum drag. In one embodiment, the air projecting apparatus is located below ground level with no above-ground structures. The air jet flow can be directed over a greater-than-90° range from horizontal toward the runway to past the vertical upwardly, as dictated by the ambient winds.

11 Claims, 11 Drawing Figures

FIG. 4
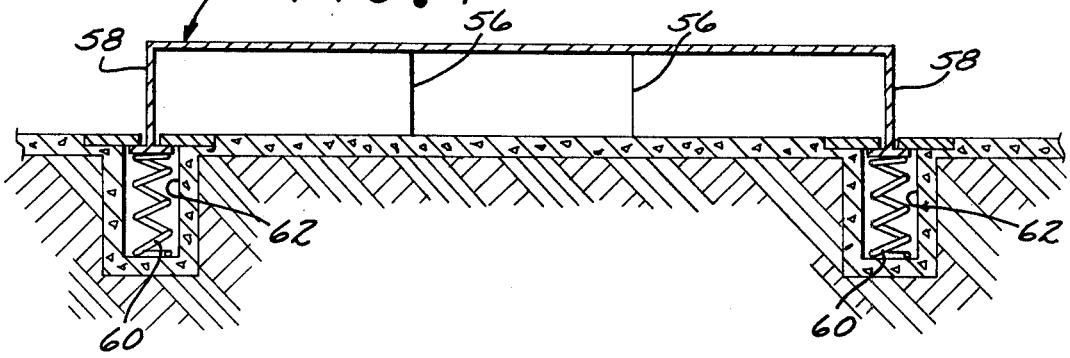
FIG. 5
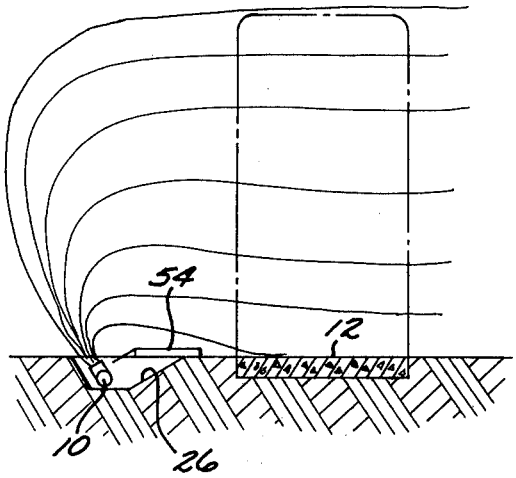
FIG. 6
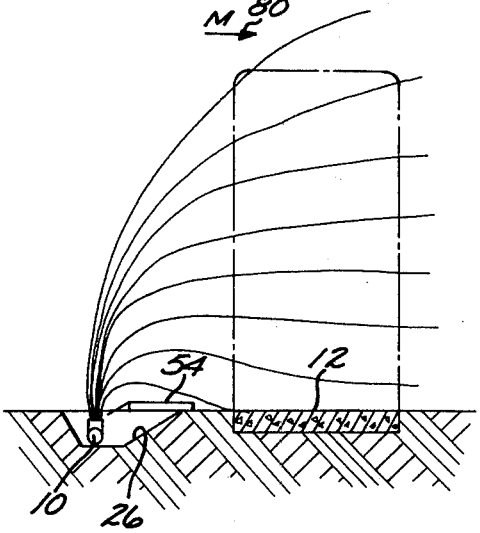
FIG. 7
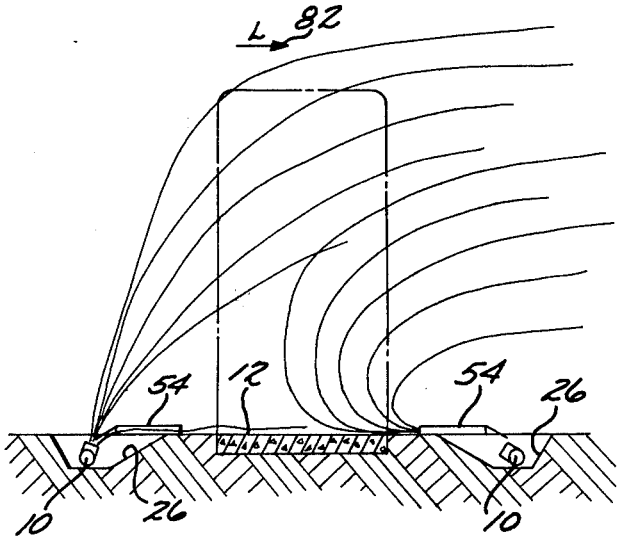
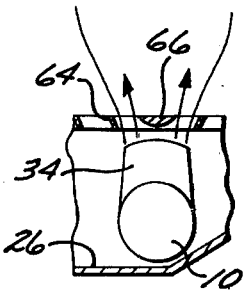
FIG. 6A

AIR FIELD SPACE HEATER FOR FOG DISPERSAL SYSTEM

CROSS-REFERENCE TO RELATED APPLICATIONS

One form of fog dispersal system for an aircraft runway is disclosed in U.S. Pat. No. 3,712,542, issued Jan. 23, 1973, and entitled "Fog Dispersal System." The patent discloses a system of heaters of various intensities distributed at different distances from the sides of a runway. The heaters produce plumes or jets of heated air which rise to different levels, expanding and merging over the runway in adjoining layered relation to effect the desired fog dispersal. Selected ones of the heaters are operated to create a pattern of heated air best suited for the particular wind conditions present. The object of the system is to generate heated air which rises, expands and circulates over the runway, utilizing the prevailing wind where possible. The height of the heated air produced by each heater is influenced primarily by the intensity of the heat, and to a lesser degree by the velocity and temperature of the air as it leaves the heater. That system is essentially a passive one in which distribution of the heated air is accomplished by the characteristic behavior of rising heated air under the influence of a prevailing wind.

The present heaters provide an active means for achieving the desired heated air condition above a runway through control of the thrust and direction of projection of jets or streams of heated air toward the runway. The heated generation required is greatly reduced as compared to a passive system.

BACKGROUND OF THE INVENTION

FIELD OF THE INVENTION

The present invention relates to an air field space heater for a fog dispersal system and particularly to a heater which disperses fog over a specific ground area by supplying heat to the air mass containing the fog.

DESCRIPTION OF THE PRIOR ART

An air mass such as the corridor of air over an airport runway can be cleared of fog by warming the air approximately 2° to 5° F. Prior art systems for dispersing fog by heat application have not been practical primarily because of the inability of such systems to utilize prevailing winds of every direction for efficiently distributing the heated air within the air mass to be cleared and, where thrust air is used, because they have required excessive horsepower and were too limited in their application of the direction of thrust.

One system of the prior art utilizes a line of closely spaced fires or burners to generate heated air, which rises by convection. Although this heated air can be carried over the runway by the prevailing wind, the cumulative and excessive convection produced by the line of heat sources caused the heated air to be carried to the higher reaches over the runway without heating an appreciable volume in the lower reaches. In a variation of this system, a line of small closely spaced burners was provided to produce an essentially continuous line of heat sources. This was intended to form a curtain of heated air perpendicular to any prevailing wind blowing across the runway. However, excessive fuel consumption and lack of accommodation of the system to changing wind conditions rendered the system impractical.

Another prior art system is described in U.S. Pat. No. 3,712,542, which has already been mentioned. In that system heat sources of different intensities were arranged along one or both sides of a runway at different distances, and selected ones of these heaters were operated to provide plumes or jets of heated air. Successful operation of the system depended upon selective operation of the heaters, so that the selected combination of small and large heaters, at the selected distances from the runway, generated a combination of heated air jets that would rise, expand and merge over the runway. Although tests of the system proved to be satisfactory, an improved system was sought which would be able to effect an even more efficient and predictable heating of the air mass over a runway or the like under a variety of wind and other environmental conditions.

A further prior art system is disclosed in U.S. Pat. No. 3,118,604, entitled "Directing Nozzle for Discharging Gas Along the Surface of the Ground." Equipment there described uses jet engines located underground and having their exhausts directed in a controlled manner to effect fog dispersal over a runway. The objective of the invention is to turn the hot gases rising from the jet engine and direct them horizontally along the ground. The invention is limited to directing the gases horizontally, with the added flexibility of directing them in different directions about a vertical axis. The present invention achieves a similar horizontal direction for the gases, but by a different means. The present invention creates a process of warm plume shape control without resorting to changes in direction about a vertical axis. The present invention uses control of the direction of exhaust gases about a horizontal axis nominally parallel to the runway or at some fixed direction relative to the runway direction which is determined on the basis of known history of foggy wind velocity and direction at a given runway. For example, with wind most frequently moving down the runway direction the axis would be canted in a fixed position canted toward the wind for most efficient use of the plume thrust to place the warm plume over the runway.

The present invention also has a greater versatility of range in heat/thrust ratios, which can be automatically controlled for the most effective placement of the warm plume. For example, with a wind coming from behind the combustors and moving over the runway, the angle of deflection would be increased and the heat/thrust ratio would also be increased. At very high winds both the heat and thrust would be greatly increased to lift the plume high enough before it reached the runway region. On the opposite side of the runway, with the wind moving toward the row of combustors, a low angle of exhaust would be used along with a long heat/thrust ratio. This can be done because the thrust air and combustor are separate units within the system unlike that of the jet engine used in U.S. Pat. No. 3,118,604. The system of the patent uses an expensive, sophisticated thrustor based on very high shaft horsepower, exhaust velocities and exhaust temperatures. The present invention works with much lower horsepower, velocities and temperatures.

British Pat. No. 974,999 (1964) is yet another system of the prior art. The patent teaches the ducting of cold air around the runway in pipes extending the full perimeter of the runway, which results in a far more expensive sytem than the present invention. The design of the variable angle nozzles is not given and there is no mention of how the wind is controlled by the setting of the nozzles to hold the clearing over the runway. The arrangement of cold air flow generators and sources of heat are entirely different from the present invention.

British Pat. No. 587,521 (1947) is still another prior art system. The apparatus is described as having five-inch diameter orifices. The size and number of orifices would dictate a much higher thrust requirement for the same plume penetration into the wind compared to the present invention. The system uses continuous piping around the runway perimeter and the orifices are simple round holes. The patent omits a teaching of the arrangement of heating and of mixing of the propulsion air and combustor exhaust. The patent does not describe any method for varying the angle of the heat or cold air projection at the exhaust outlet, rather, the orifices are fixed in position. The exhaust orifices are relatively small, such that the system develops a two-dimensional curtain-like layer of warm air very close to the sources. The system does not project exhaust horizontally, but depends on "falling-down" mechanisms to move the exhaust horizontally along the ground. In contrast, the present invention uses a higher mass flow and lower velocity air propulsion. Consequently, much less shaft horsepower is required for the prime mover and a much lesser degree of turbulence is produced over the runway. One embodiment of the present invention provides thrust vector change and low vector exhaust angles without the use of above-ground side walls to confine and direct the use of above-ground side walls to confine and direct the exhaust flow. The plume characteristic is given in part by the ratio of exhaust velocity to temperature. Having lower velocity for a given thrust, the present invention creates a lower exhaust temperature and this results in an economic savings by virtue of the less expensive materials which can be used. Also, the lower velocity jet reduces the possibility of damage to equipment on the runway in the direct path of the exhaust flow.

SUMMARY OF THE INVENTION

According to the present invention, a relatively active or positive system results from use of an air field space heater which controls heated air circulation or flow in the region above a runway or the like where fog is to be cleared. The air is heated and propelled in relatively predictable air flow patterns that minimize movement of cool air into the cleared volume, and minimize movement of heated air out of the cleared volume. The thrust and direction of heated air jets is controlled according to ambient wind conditions. In particular, the present space heater is operative to generate and project jets of heated air at predetermined angles of inclination relative to the plane of the runway, according to ambient wind conditions.

The heater includes a duct in fluid communication with a heat source, and an air projector in communication with the duct to receive the heated air and direct or project it in the form of a jet of heated air. The configuration of the rotating elbow projector, in contrast to movable vanes or the like, provides a lower loss means to change the direction of the flow of heated air to follow the desired path upwardly or toward the runway, as required. The coupling mechanism supporting the air projector permits pivotal movement of the projector relative to the duct to achieve the desired angle of inclination of the projected jet. This angle varies to achieve optimum dispersion of the jet according to the ambient wind conditions.

In one embodiment the present heater includes a projector having an elbow with an upstream portion pivotable about a generally horizontal axis, and a downstream portion directable upwardly, toward the runway, or even away from the runway, depending upon the applicable wind conditions.

The projector may be recessed below the level of the runway, in which case a wall portion of the pit within which it is recessed is arcuately sloped to enable projection of the jet at very low angles of inclination relative to the plane of the runway. A splitter plate may be arranged in overlying relation to the projector to form a flow path with the pit wall. The splitter plate can also be utilized to divide the flow of air between a horizontal path and a path of higher inclination. Further, the splitter plate may be made a part of a horizontal cap operative to receive the heated air and confine it in a horizontal path for a short time to better direct it along the ground and toward the runway.

Under certain conditions it is advantageous to provide relatively wide dispersion of the heated air, and the present heater may therefore include a spreader located over the projector to cause lateral diffusion of the heated air jet when the path of the air jet is directed generally upwardly.

Thus, by utilizing the present heater it is possible to more precisely inject heated air exactly where it is needed to clear fog over a given region. With this arrangement, there is better development of air curtains or barriers at the sides of the runway to block convective currents due to ambient or induced winds which would otherwise pass through the cleared volume of air above the runway. Proper heated air injection with the present heater modifies the wind flow as it approaches the volume to be cleared such that the cleared volume is protected somewhat from the sweepthrough of the ambient wind. This obtains maximum benefit from the heat which has injected to form the cleared volume.

The aspects of the heater which indicate it to be particularly versatile and adaptable to runway use are the designs to preclude above-ground hazards to equipment moving along the ground surface and the ability to use two sources of heat and thrust matched with a single, double-ended power source.

Other objects and features of the invention will become apparent from consideration of the following description taken in connection with the accompanying drawings.

BRIEF DESCRIPTION OF THE DRAWINGS

FIG. 4 is an enlarged cross-sectional view taken along the line 4—4 of FIG. 3;

FIG. 5 is a generally diagrammatic end elevational view of the runway and the heaters at one side of the runway, as shown in FIG. 1, and particularly illustrating the heated air dispersion pattern established in a high wind with the projector inclination shown;

FIG. 6 is a view like that of FIG. 5, with a different projector inclination in a medium wind;

position of rotation toward the runway, the lower portion of the elbow 28 is generally aligned with a splitter plate 52. The plate 52 is arranged generally parallel to the wall portion 50 and extends from a point closely adjacent the elbow 28, as illustrated, to a point approximately flush with the ground. The splitter plate 52 is mounted in any suitable manner and is operative in the illustrated position of the elbow 28 to confine most of the heated air to a path close to the ground. When the elbow 28 is rotated to discharge heated air at an angle such as that illustrated in FIG. 7, the heated air is split into two paths, one generally at ground level and the other generally upwardly.

Figure 3:
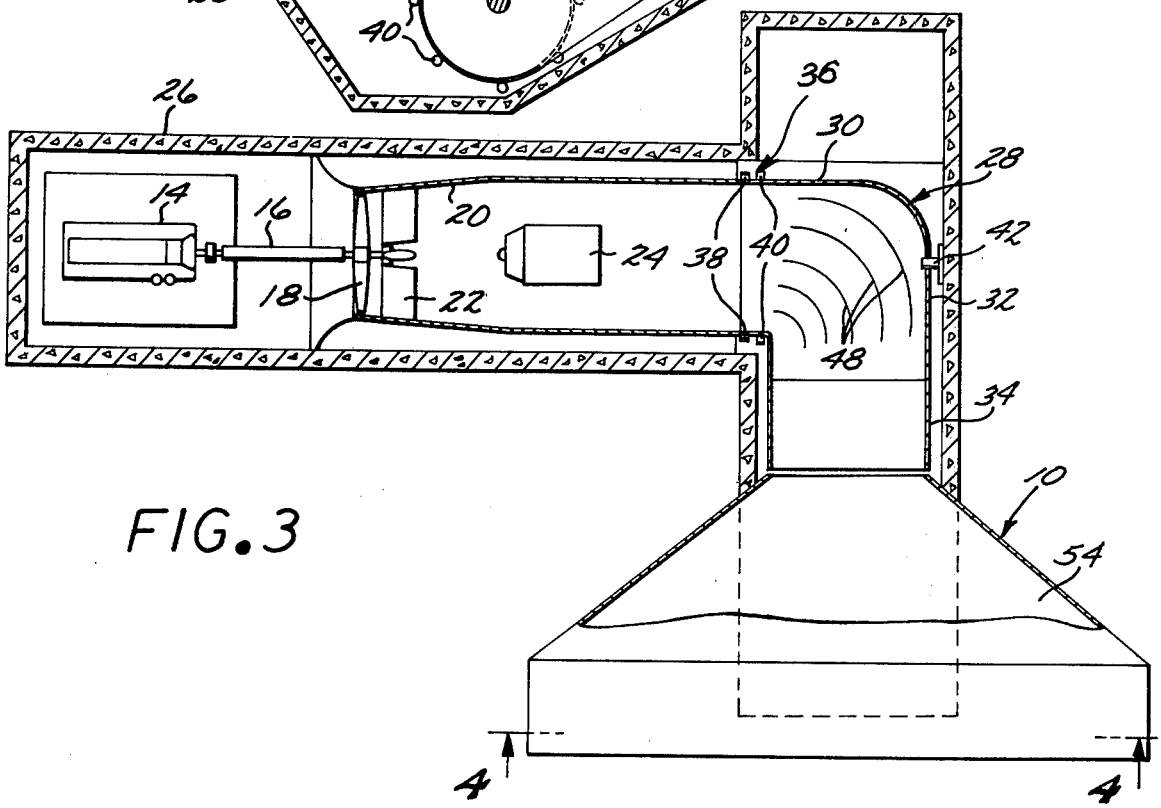
FIG. 3 is a plan view of the heater of FIG. 2.

Adherence of the heated air to the surface of the ground as it leaves the elbow nozzle 34 may be enhanced by a horizontal cap 54 which forms an inclined and thereafter horizontal continuation of the splitter plate 52. The cap 54 is closed at its sides and top and provides a confined passage for projecting the heated air horizontally at ground level. The cap 54 is laterally divergent, as best seen in FIG. 3, which reduces the height of the projected stream of heated air. The cross-sectional area of the cap, however, is preferably maintained constant between its upstream and downstream extremities to reduce kinetic energy losses.

Figure 1:
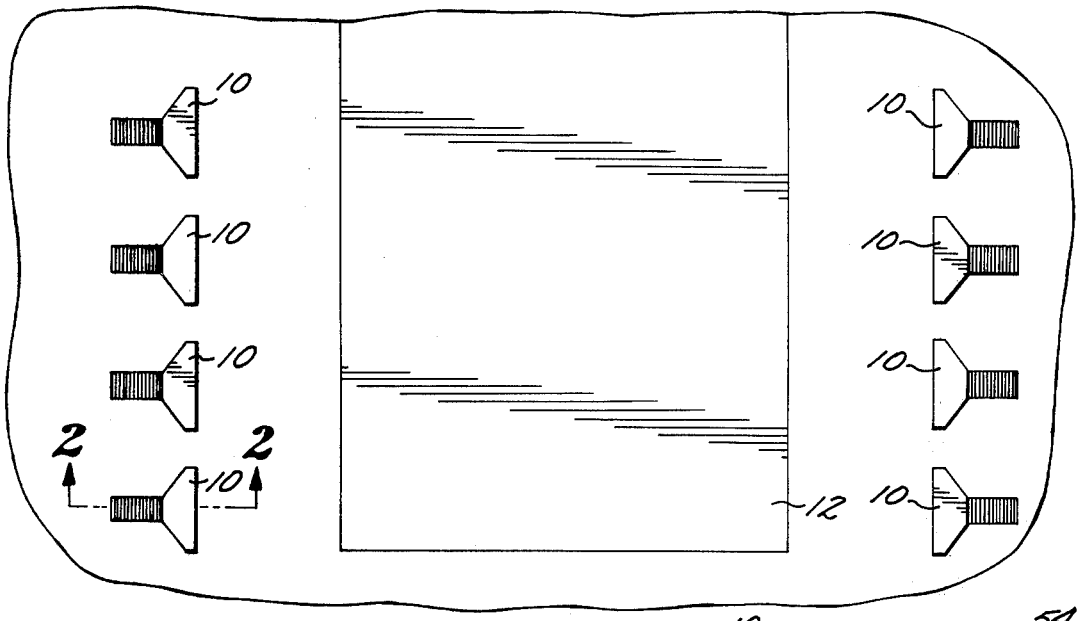
FIG. 1 is a partial, generally diagrammatic top plan view illustrating a plurality of heaters according to the present invention, arranged along the sides of an aircraft runway.
Figure 2:
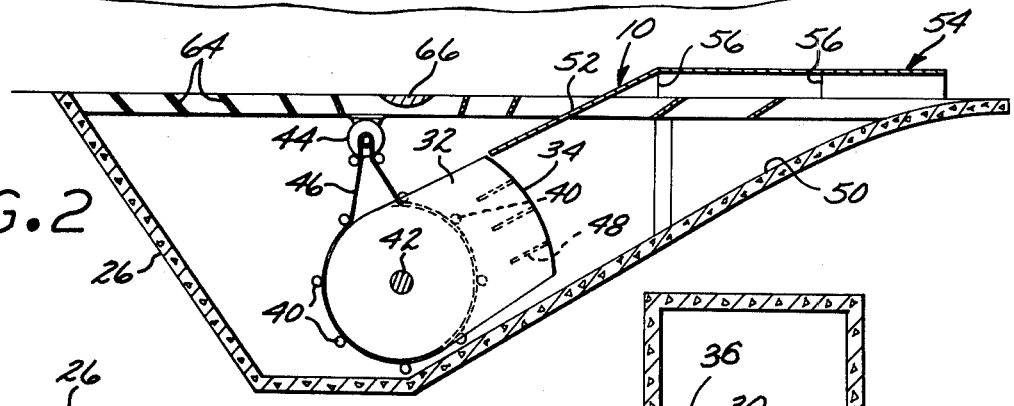
FIG. 2 is an enlarged cross-sectional view taken along the line 2—2 of FIG. 1.

The cap 54, which is optional, may be made of light weight sheet metal held in place against the thrust of the upwardly flowing heated air by cables 56, as diagrammatically shown in FIGS. 2 and 4. The cap 54 is retractable into flush or flat relationship relative to ground level in the absence of air flow through the heater 10. For this purpose, the sides 58 of the cap are movable downwardly against the bias of compression springs 60 into recesses 62. The springs 60 compress under the weight of the cap 54 and allow the cap 54 to lie flush with the ground surface. However, the spring rate of the springs is such that only a slight flow of heated air is sufficient to raise the projector 54 to its operative position.

In its farthest position of rotation away from the runway 12, the elbow 28 directs all of the heated air upwardly and away from the runway at an angle somewhat less than 90°, the only obstruction to the flow of heated air being the grillwork 64 which is provided to support aircraft or other vehicles which might accidentially travel into the area. When the elbow nozzle 34 is directed vertically upwardly, the flow of heated air impinges against a spreader 66 suitably supported by the grillwork 64. The spreader 66 diffuses and laterally spreads the upwardly directed jet of air.

When the elbow nozzle 34 faces toward the runway 12, at an angle of approximately 30° to 85° relative to a horizontal plane, the heated air is divided by the splitter plate 52 into two portions, one directed upwardly and the other directed horizontally through the cap 54. The net effective thrust angle of the heated air thus is a combination of the two flows, with the net effective thrust angle becoming higher as the elbow nozzle 34 rotates to a higher angle.

Use of the elbow 28 allows the angle of inclination of the jet of projected air to be easily changed to conform to the various wind directions and velocities, and thereby maintain a uniform zone of cleared or heated air over the runway 12.

Figure 10:
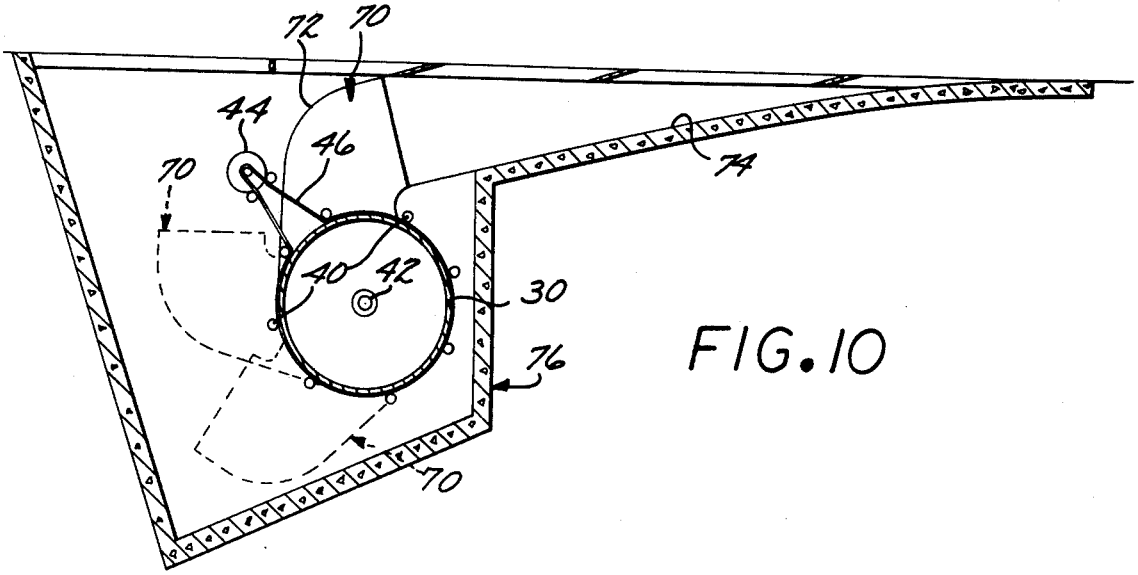

FIG. 10 is illustrative of a different embodiment of the present apparatus in which a heater 10 is provided with an elbow 70 instead of the elbow 28, the splitter plate 52 and the cap 54 of the first embodiment. The elbow 70 redirects heated air from the axis of duct 20 to a transverse axis, as did the heater 10. In addition, the elbow 70 includes an angular turn 72 which can be oriented to discharge the heated air close to ground level, at a right angle to the transverse portion of elbow 70, and in the direction of the runway 12. As is apparent from the drawings, the discharge axis of the turn 72 is disposed approximately normal to the longitudinal axis of the duct 20, and laterally spaced therefrom. The curved section of the wall portion 74 merges smoothly with the adjacent surface of the ground near the runway to avoid an abrupt change of direction to the path of the heated air flowing upwardly along the channel. This gradual turn and channel shape tend to cause the jet of heated air leaving the elbow nozzle 34 to bend downwardly under the influence of differential pressure and cling to the ground as it proceeds toward the runway 12, which is advantageous under certain wind conditions.

The elbow 70 can be rotated to rotate the discharge axis of the elbow turn 72 about the axis of the duct 20, and in a plane generally normal to the axis of the duct 20 such that the angle of discharge of the heated air is approximately 90° or, as illustrated, to an angle in excess of 90°. This is achieved by making the pit 76 deep enough and wide enough to provide space for the necessary rotation of the elbow 70.

FIGS. 5 through 8 are examplary of different patterns of air flow which can be achieved by different orientations of the heater 10 under various prevailing wind conditions. The examples are simply to illustrate the utility of the present apparatus and are not exhaustive of the various combinations of heater orientation which can be established to meet the various fog dispersal conditions.

In FIG. 5, a high cross wind is blowing toward the runway, as denoted by the letter "H" and arrow 78. The up-wind heaters 10 are rotated to discharge or direct their heated air jets generally upwardly so that the heated air can rise sufficiently before it is carried over the runway 12.

FIG. 6 illustrates the upward orientation of the heaters 10 in a medium wind condition 80.

FIG. 7 illustrates the orientation of the heaters 10 on both sides of the runway when a low wind 82 is blowing toward the runway. The upwind heaters 10 are rotated to project their heated air at an angle such that part of the flow is divided by the splitter plate 52, a portion rising to the higher reaches over the runway, and a portion flowing substantially horizontally toward the runway at ground level. The downwind heaters 10 are oriented to discharge their heated air into the overlying caps 54, directly into the wind, and the illustrated heated air pattern is thereby developed to clear the lower reaches over the runway 12.

Figure 8:
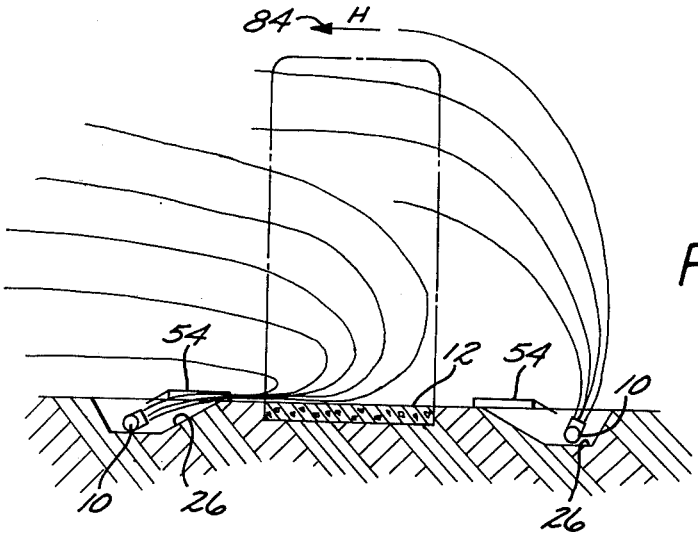

FIG. 8 illustrates a condition like that of FIG. 7 except that a high wind 84 is blowing from the opposite side of the runway. The showing is demonstrative of the ease with which a change in wind direction can be readily met by simply rotating the heaters 10 in directions opposite those shown in FIG. 7. It also shows how the downwind heaters are used in a two-row scheme to buck the wind and help lift the upwind plume.

Figure 9:
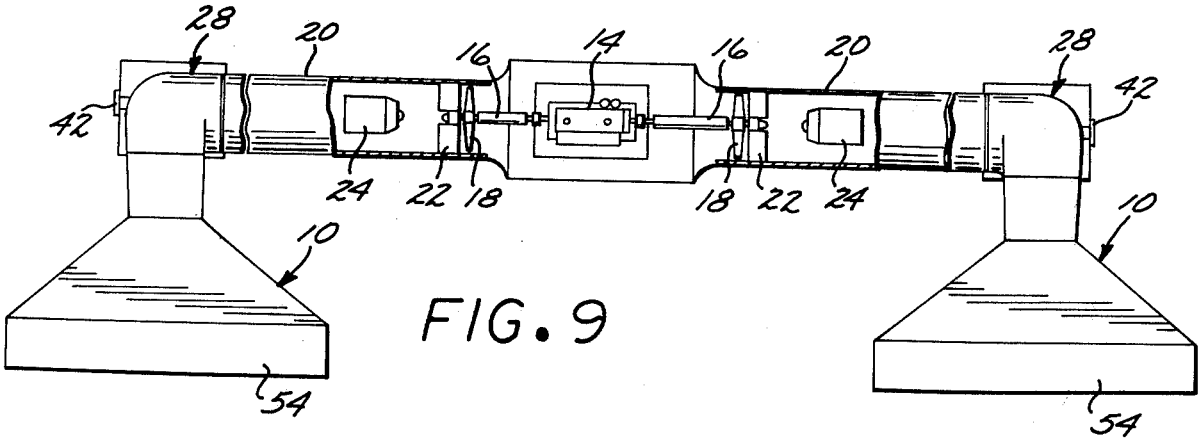

The heaters 10 are preferably located 25 to 150 feet apart, and approximately 50 to 150 feet from the sides of the runway along the roll-out portion of the runway, and approximately 200 to 500 feet along the approach portion of the runway. These distances minimize the FIG. 6A is an enlarged view of the air projector of FIG. 2, illustrating the lateral dispersion caused by the spreader overlying the projector;

FIG. 7 is a view like that of FIG. 5, with a different projector inclination in a low wind, and further illustrating the effect of also operating the projectors on the opposite side of the runway;

FIG. 8 is a view similar to FIG. 7, and particularly illustrating the inclination of the air projectors in a high wind;

FIG. 9 is a top plan view of an apparatus similar to that of FIG. 3, but utilizing a pair of the air jet projectors coupled to a single blower impeller drive means; and FIG. 10 is a vertical cross-sectional view of a second embodiment of the present heater.

DESCRIPTION OF THE PREFERRED EMBODIMENTS

Referring now to the drawings, there is illustrated a fog dispersal system comprising a plurality of air field space heaters 10, their exhaust portions being generally diagrammatically shown in spaced relation along the sides of a usual airport runway 12. The runway is just one application for the fog dispersal system utilizing the space heaters with their exhaust portions 10. Obviously the system could be utilized for clearing fog in a variety of other applications.

In order to heat the air mass over the runway 12 to effect fog dispersal, it is necessary to generate heat at the side of the runway and then project that heat as warm air plumes which are capable of spreading widely and arriving at the runway as a large and uniformly heated mass. The heat sources are spaced apart along a line parallel to the runway and set back a distance away from it. For example, the spacing might be 50 feet, with the distance from the runway being 150 feet.

Any system of fog dispersal must be effective under a wide variety of wind directions and velocities. With the present system, as will be seen, the angle of inclination of the air jets emanating from the exhaust portions of the heaters 10 can be changed as needed. By way of example, if the wind is blowing relatively hard across the runway, the up-wind heaters are arranged to direct the jets of heated air toward the wind or straight upward in order to have the heat rise far enough before the heated air is carried over the runway. The downwind heaters, however, would be aimed to direct their warm air jets into the wind at an angle as nearly horizontal as possible. The up-wind heaters effect good spreading of the heated air before the air bends back in the wind and flows over the runway, while the downwind heaters cause their heated jets to oppose the wind and spread through the lower region close to the runway surface for clearing fog in a variety of situations.

With particular reference to the heaters 10 of FIGS. 2 and 3, any suitable means can be utilized for generating the necessary heated air for the heaters. A satisfactory means may include a diesel engine 14 coupled by a drive shaft 16 to an air impeller 18 which is located in a combustor conduit or duct 20. Usual straightening vanes 22 are supported in alignment with the longitudinal axis of the duct 20 and downstream of the impeller 18. Downstream of the vanes 22 is a burner 24 suitably supported in coaxial relationship with the duct 20. Such components are well known to those skilled in the art and therefore will not be described in detail.

The equipment is preferably located underground, out of the way of aircraft and service vehicles. For this purpose there is provided a concrete or steel lined pit 26 which is upwardly open through a suitable grillwork (not shown). Inlet air is drawn through the grillwork by the impeller 18, and this air is heated by the burner 24 and discharged into the associated heater 10.

The heater 10 comprises an elbow 28 having an upstream portion 30 characterized by a longitudinal or flow axis coaxial with the adjacent duct 20. The downstream portion 32 of the elbow 28 is characterized by a flow axis which extends laterally of the axis of the duct 20. Portion 32 terminates in a nozzle 34.

The elbow 28 of the heater 10 is thus in fluid communication with the duct 20 and receives heated air which is redirected by the elbow 28 into a jet which is disposed at a predetermined angle of inclination relative to the plane of the runway 12. The elbow 28 thereby provides an effective means for accepting heated air traveling below ground level along a path parallel to the runway, and changing that path to one which is above ground, normal to its original path, and also at a desired angle of inclination relative to the plane of the runway. The elbow 28 accomplishes this with a minimum loss of energy compared to systems utilizing moving deflectors, flow directing movable panels or the like.

The angle of inclination of the nozzle 34 is adjustable by virtue of the connection between the elbow 28 and the duct 20. As best seen in FIGS. 2 and 3, a coupling mechanism 36 in the form of a pair of overlapping flanges 38 is provided at the adjacent, complemental ends of the projector upstream portion 30 and the duct 20.

The coupling mechanism 36 includes a plurality of rollers 40 suitably attached to the adjacent walls of the pit 26 to align and support the elbow 28 during its rotative movement. Further support is provided by a trunnion 42 mounted to the adjacent wall of the pit 26. Although not shown, the elbow can also be suspended and rotated about a shaft extending through its center and aligned as an extension of the axis of the duct 20.

As diagrammatically shown in FIG. 2, the elbow 28 can be rotated by any suitable actuating means, such as a motor 44 having its drive shaft connected to a belt or chain 46 which is trained radially inwardly of the plurality of rollers 40. The rollers 40 are circumferencially spaced about the upstream extremity of the elbow 28 so that during operation of the motor 44 the rollers 40 both support and rotate the elbow 28. Any suitable means may be employed for rotating the elbow 28 in the manner described, the motor 40 merely being exemplary.

It is contemplated that the actuating means for rotating the elbow 28 will be responsive to a suitable control system (not shown) having a number of sensors strategically disposed in the vicinity of the runway 12 and adapted to sense the environmental conditions affecting selection of the proper angle of inclination of the various elbow nozzles 34. Details of a suitable control system are omitted since such a system forms no part of the present invention.

The change of direction, without severe friction losses, of the heated air as it passes through the elbow 28 is aided by fixed, arcuate vanes 48, as diagrammatically indicated in FIGS. 2 and 3.

With reference to FIG. 2, the pit 26 includes a sloped wall portion 50, generally arcuate at its upper extremity and extending upwardly and outwardly toward the runway at a relatively shallow angle. In its maximum heat and thrust momentum requirements. Since the runway and approach portions total 12,000 feet or more, a considerable number of heaters 10 is required in the usual fog dispersal installation. FIG. 9 illustrates an installation which reduces the number of engines required. A single engine 14 is utilized to drive a pair of shafts 16 for operating a pair of impellers 18. A pair of burners 24 heat the air for discharge into a pair of heaters 10, which are spaced apart the desired distance along the side of the runway. Typically, a row of such installations would be arranged at one or both sides of the runway. The use of a single engine in each such installation greatly reduces the cost and simplifies the control of the fog dispersal apparatus. Whenever design or cost considerations dictate an arrangement in which the pair of heaters 10 are spaced apart a distance greater than would supply adequate heat or thrust per unit length of runway, a second row of installations such as that illustrated in FIG. 9 could be located behind and parallel to the first row. The heaters 10 of the second row would be located substantially midway between the heaters 10 of the first row, as will be apparent.

Further economies can be practiced for the approach region of the runway by locating the heaters above ground. In this region aircraft are high enough above the ground that the heaters would not be a hazard. The heaters, either of the type shown in FIG. 2 or in FIG. 10, could be located on a strand or the like (not shown) in an elevated position above the ground. The operation of the heaters would be as previously described. However, the expense of a pit, a protective grating, and underground lines and fittings for each heater would be eliminated.

Various modification and changes may be made with regard to the foregoing detailed description without departing from the spirit of the invention.

We claim:

1. In a fog dispersal system for an aircraft runway or the like, wherein said system includes a plurality of burners for generating heated air, an improved air field space heater means for directing heated air jets at various angles of inclination relative to the plane of the runway, said heater means comprising:

a walled pit recessed below the level of said runway, a wall portion of said pit rising at a shallow angle relative to the plane of said runway;

duct means in fluid communication with a burner for receiving heated air;

an elbow in said pit in fluid communication with said duct means and having an outlet, said elbow being operative to receive heated air from said duct means and project a jet of said heated air from said outlet at a predetermined angle of inclination relative to the plane of said runway, said outlet being generally alignable with said wall portion of said pit whereby said angle of inclination of said jet is a relatively shallow angle;

coupling means supporting said elbow for pivotal movement for varying said angle of inclination of said jet between said relatively shallow angle and higher angles of inclination whereby the dispersion characteristics of said jet may be varied; and a splitter plate spaced from and arranged substantially parallel to said wall portion, the outer extremity of said splitter plate extending at least to ground level, the inner extremity of said splitter plate being adjacent said elbow upon said alignment of the bottom of said outlet of said elbow and said sloped wall portion whereby said splitter plate tends to reduce dispersion of said jet upwardly of said pit during said alignment.

2. In a fog dispersal system according to claim 1 wherein said splitter plate extends above ground level, and including a horizontal cap forming a generally horizontal continuation of said splitter plate, and having a discharge outlet, and operative to project said jet out of said discharge outlet toward said runway at ground level upon alignment of said outlet of said elbow and the space between said sloped wall portion and said splitter plate.

3. In a fog dispersal system according to claim 2 wherein the discharge outlet of said cap and said outlet of said elbow are approximately the same in cross sectional area, said cap being divergent in the direction of said runway and of generally uniform height at said discharge outlet whereby said discharge outlet is relatively wide and low.

4. In a fog dispersal system for an aircraft runway or the like, wherein said system includes a plurality of burners for generating heated air, an improved air field space heater for directing heated air jets at various angles of inclination relative to the plane of the runway, said heater comprising:

duct means in fluid communication with a burner for receiving heated air;

an elbow in fluid communication with said duct means and having an outlet, said elbow being operative to receive heated air from said duct means and project a jet of said heated air from said outlet at a predetermined angle of inclination relative to the plane of said runway;

coupling means supporting said elbow for pivotal movement for varying said angle of inclination of said jet whereby the dispersion characteristics of said jet may be varied; and a spreader arranged above said elbow, said spreader being generally vertically aligned with said outlet of said elbow when said angle of inclination is approximately 90° relative to the plane of said runway whereby said spreader is impinged by said jet and tends to enhance lateral diffusion of said jet.

5. In a fog dispersal system for an aircraft runway or the like, wherein said system includes a plurality of burners for generating heated air, an improved air field space heater for directing heated air jets at various angles of inclination relative to the plane of the runway, said heater comprising:

duct means in fluid communication with a burner for receiving heated air;

an elbow in fluid communication with said duct means and having an outlet, said elbow being operative to receive heated air from said duct means;

coupling means supporting said elbow for pivotal movement relative to said duct means; and a cap having an inlet adapted for alignment with said outlet of said elbow, said cap extending generally horizontally and terminating in an outlet directed toward said runway, thereby defining a generally horizontal path for projecting a jet of said heated air at a substantially zero angle of inclination relative to the plane of said runway.

6. In a fog dispersal system according to claim 5 and including recesses in the ground receiving said cap in flush relationship to the ground, and further including bias means normally biasing said cap upwardly of said recesses.

7. In a fog dispersal system for an aircraft runway or the like, wherein said system includes a pair of burners for generating heated air, a pair of air propulsion means for conveying air past said burners, and an engine drive means located between said pair of burners and air propulsion means, an improved air field space heater for directing heated air jets at various angles of inclination relative to the plane of the runway, said heater comprising:

means coupling said engine drive means to said pair of air propulsion means whereby both said air propulsion means are operated by said engine drive means;

a pair of ducts in fluid communication with said pair of burners, respectively, for receiving heated air and conveying said heated air parallel to a runway and in opposite directions relative to said engine drive means;

a pair of air elbows in fluid communication with said pair of ducts, respectively, and operative to receive heated air from said pair of ducts and project a pair of jets of said heated air substantially at right angles to said runway and at a predetermined angle of inclination relative to the plane of said runway; and coupling means supporting each said air elbows for pivotal movement relative to the associated one of said pair of ducts for varying said angle of inclination of said jets whereby the dispersion characteristics of said jets may be varied.

8. An air field space heater comprising:

a rotational power source having air propulsion means mounted on opposite ends thereof and operative to move air in opposite directions parallel to the runway;

duct means in fluid communication with said air propulsion means for receiving air;

a pair of elbows in fluid communication with said duct means and operative to receive air from said duct means and project a pair of jets of said air at a predetermined angle of inclination relative to the plane of said runway; and coupling means supporting each said elbow for pivotal movement relative to said duct means for varying said angle of inclination of said jets.

9. In a fog dispersal system for an aircraft runway or the like, wherein said system includes a plurality of burners for generating heated air, an improved air field space heater means for directing heated air jets at various angles of inclination relative to the plane of the runway, said heater means comprising:

a walled pit recessed below the level of said runway and extending generally toward said runway, said pit having a wall portion rising at a shallow angle and curving to tangency with said level;

duct means in fluid communication with a burner for receiving heated air;

an elbow in said pit in fluid communication with said duct means and having an outlet, said elbow being operative to receive heated air from said duct means and project a jet of said heated air from said outlet at a predetermined angle of inclination relative to the plane of said runway, the bottom of said outlet being generally alignable with said wall portion whereby said angle of inclination is relatively shallow; and coupling means supporting said elbow for pivotal movement for varying said angle of inclination of said jet between said relatively shallow angle and higher angles of inclination whereby the dispersion characteristics of said jet may be varied.

10. In a fog dispersal system for an aircraft runway or the like, wherein said system includes a plurality of burners for generating heated air, an improved air field space heater for directing heated air jets at various angles of inclination relative to the plane of the runway, said heater comprising:

duct means in fluid communication with a burner for receiving heated air, said duct means having a longitudinal axis; and an elbow including an inlet portion in fluid communication with said duct means, and further including an outlet portion having a discharge axis spaced laterally of said longitudinal axis of said duct means, said elbow being adjustably pivotable thereby to pivot said discharge axis about said longitudinal axis of said duct means, and in a plane generally normal to said longitudinal axis of said duct means, whereby heated air received from said duct means is projected in the form of a jet from said outlet portion at a predetermined angle of inclination relative to the plane of said runway and in various directions within a plane normal to said longitudinal axis of said duct means.

11. In a fog dispersal system according to claim 10 including a walled pit recessed below the level of said runway and extending generally toward said runway, said pit having a sloping surface rising at a shallow angle and curving to tangency with said level, the bottom of said outlet portion of said elbow being generally alignable with said sloping surface of said pit whereby said angle of inclination of said jet is relatively shallow.

* * * * *